US005887960A

United States Patent [19]

Lee

[11] Patent Number: 5,887,960

[45] Date of Patent: Mar. 30, 1999

[54] TRAY ASSEMBLY FOR A REFRIGERATOR

[75] Inventor: Yong-Kweon Lee, Incheon, Rep. of Korea

[73] Assignee: Daewoo Electronics Co., Ltd., Rep. of Korea

[21] Appl. No.: 955,305

[22] Filed: Oct. 21, 1997

[30] Foreign Application Priority Data

Oct. 21, 1996 [KR] Rep. of Korea ..... 1996-47275

[51] Int. Cl.[6] ..... A47B 88/00

[52] U.S. Cl. ..... 312/334.5; 312/408

[58] Field of Search ..... 312/408, 334.1, 312/330.1, 334.27, 350, 334.5

[56] References Cited

U.S. PATENT DOCUMENTS 353,640 11/1886 Nourse ..... 312/334.5

418,721 1/1890 Hoogerzeil et al. ..... 312/334.5

5,558,419 9/1996 Dasher et al. .

*Primary Examiner*—Peter M. Cuomo

*Assistant Examiner*—Gerald A. Anderson

*Attorney, Agent, or Firm*—Pillsbury Madison & Sutro, LLP

[57] ABSTRACT

A tray assembly for a refrigerator which is inserted into and withdrawn from a refrigerating compartment. The tray assembly has a tray which is slidably installed on a pair of guide members which are formed at both side walls of a refrigerating compartment, a vertical roller which is mounted on both end portions of the tray and makes contact with the guide members, a horizontal roller which is mounted at both sides of the tray and makes contact with a side wall of the refrigerator compartment. The tray assembly allows the tray to be more conveniently inserted into and withdrawn from the refrigerating compartment, thereby preventing a shakiness of the tray in the left and right directions while the tray is being inserted into or withdrawn from the refrigerating compartment.

9 Claims, 5 Drawing Sheets

TRAY ASSEMBLY FOR A REFRIGERATOR

BACKGROUND OF THE INVENTION

1. Field of the Invention

The present invention relates to a refrigerator, and more particularly to a tray assembly for a refrigerator.

2. Description of the Prior Art

Generally, a refrigerator is a household electric appliance for storing foodstuffs freshly and is divided into a freezing compartment and a refrigerating compartment. The freezing compartment stores the foodstuffs to be frozen such as meats and the refrigerating compartment stores the foodstuffs at a lower temperature.

Generally, the refrigerator is provided with a tray for efficiently utilizing a space in the refrigerating compartment, and for allowing the user to easily take out foodstuffs.

The tray can be inserted into and withdrawn from the refrigerating compartment.

And, the tray is designed in such a manner that cold air can be circulated in the refrigerating compartment and a liquid formed in the upper portion of the refrigerating compartment is guided to a lower portion of refrigerating compartment through a draining passage of the tray.

FIG. 1 illustrates a conventional tray assembly for a refrigerator 300 which is disclosed in a U.S. Pat. No. 380,279 issued to James F. Dasher, and entitled "Pull-Out Freezer Floor For Refrigerator And Freezers".

As illustrated in FIG. 1, the tray assembly 100 is provided with a base 110 which is installed on an upper surface of a bottom wall of a refrigerating compartment , a tray 120 which is slidably mounted on an upper portion of the base 110, and a plurality of rollers 130 which are interposed between the base 110 and the tray 120.

The base 110 is fixed to an upper portion of the bottom wall of the freezing compartment by a fixing means(not shown) such as a bolt, and a roller receptacle(not shown) into which the plurality of rollers 130 are installed is formed on the base 110. A plurality of roller guides(not shown) are formed on the base 110 in the longitudinal direction for allowing the tray 120 to be guided in a predetermined direction.

As illustrated in FIG. 2, the tray 120 has a handle 180 at a front portion thereof for allowing the user to easily insert and withdraw the tray 120. The tray 120 is provided with a wall 190 at both sides thereof in order to easily store foodstuffs and in order to prevent foodstuffs from dropping from the tray 120 while the tray 120 is being inserted and withdrawn. The tray 120 has through regions 200 on both front ends thereof for draining a defrosted liquid or impuritier.

FIG. 1 illustrates a side view of the tray 120 and the base 110. Each of the roller guides which is formed on the base 110 is spaced apart from each other by a predetermined interval so as to facillate inspection and withdrawl of the tray 120 and so as to properly disperse a weight of the tray 120.

Roller channels 220 are provided at a lower portion of the tray 120, and the number of roller channels 220 is the same as the number of roller guides which are formed on the base 110. Taps 172, which are protruded in the downward direction of the tray 120, are provided at a back end of the roller channels 220, and the taps 172 are inserted into the plurality of the roller guides 10. The roller channels 220 coupled to an inside of the roller guides are slidably moved on the roller guides. A rotatable vertical roller 130 makes contact with an inside of the roller channels 220 which are mounted on a lower portion of the tray 120 so that the tray 120 can be slidably inserted and withdrawn with respect to the base 110.

However, in the conventional tray assembly 100 for a refrigerator, since the tray assembly 100 is shaken in the left and right directions while the tray assembly 100 is being inserted and withdrawn, it is very difficult to insert and withdraw the tray 120 smoothly.

SUMMARY OF THE INVENTION

Accordingly, the present invention is contrived to solve the foregoing problems, and an object of the present invention is to provide a tray assembly for a refrigerator capable of allowing the user to easily insert and withdraw the tray, and of preventing the tray from shaking in the left and right directions while the tray is being inserted into or withdrawn from the refrigerating compartment.

In order to achieve the above object, the present invention is provided with a tray assembly for a refrigerator comprising:

a tray slidably coupled to a pair of guide members which are installed at both side walls of a refrigerating compartment;

a first means for allowing the tray to be easily inserted into and withdrawn from the refrigerating compartment, and being mounted at both end portions of an underside of the tray; and a second means for allowing the tray to be easily inserted into and withdrawn from the refrigerating compartment and for preventing the tray from shaking in the left and right directions while the tray is being inserted into and withdrawn from the refrigerating compartment, and being mounted at both side surfaces of an underside of the tray.

The tray consists of or includes a panel for storing foodstuffs thereon and an outer frame for encompassing the panel. The outer frame is provided with a pair of grooves at both lower end portions thereof for mounting the first means at an inside of the pair of the grooves.

The first means including a roller bracket which is mounted in the groove of the outer frame, a vertical roller which is installed in the roller bracket so as to make contact the guide members, and a rotating pin for rotatably coupling the vertical roller to the roller bracket. The first means further comprises an E-ring which is coupled to an end part of the rotating pin for preventing the rotating pin from separting from the vertical roller.

The outer frame is provided with a pair of the recesses in front of the vertical roller, and each of the recesses is provided with a first and second coupling pins which are downwardly protruded for supporting the second members. The first coupling pin is spaced apart from the second coupling pin by a predetermined interval. The second means includes upper and lower plates which are coupled to the first and second coupling pins. A moving bar is inserted into the second coupling pin, is disposed between the upper and lower plates and is provided at a free end portion thereof with a supporting shaft which is protruded in the upward direction.

A horizontal roller is rotatably coupled to the supporting shaft of the moving bar and a spring is placed between the moving bar and the upper plate. The spring pushes the moving bar toward an inner wall of the refrigerating compartment so that the horizontal roller rotatably makes contact with the inner wall of the refrigerating compartment. The free end portion of the moving bar is downwardly stepped and the supporting shaft has a length larger than a width of the horizontal roller.

The first coupling pin and the second coupling pin are respectably inserted into holes formed at both end portions of the upper and lower plates, and a bush for keeping a distance between the upper and lower plate is provided at a position between the upper and lower plates which corresponds to a position of the first coupling pin. The spring includes a torsion spring having a first leg part, a second leg part and on annular ring part which is formed between the first leg part and the second leg part, and the first leg part of the spring makes contact with a supporting shaft of the moving bar so that the moving bar is forced toward the inner wall of the refrigerating compartment. The second leg part is fixedly supported by the bush. The second means further comprises a pair of E-rings which are coupled to end portions of the first and second coupling pins for preventing the second means from separating from the first and second coupling pins.

The tray assembly for a refrigerator according to the present invention can be slidably moved while the tray assembly is inserted into and withdrawn from a refrigerating compartment. Vertical roller parts includes a roller bracket mounted in the groove of the outer frame, a vertical roller installed in the roller bracket so as to make moving contact with the guide members, and a rotating pin for rotatably coupling the vertical roller to the roller bracket.

And while the tray assembly 300 is inserted into and withdrawn from a refrigerating compartment, the horizontal roller part 360 which is placed in front of the vertical roller part 340 is elastically in contact with an inner wall 392 of the refrigerator so that a shakiness of the tray in the left and right directions is prevented.

As described above, the tray assembly for the refrigerator of the present invention has an advantage that the tray assembly can be inserted into and withdrawn from a refrigerating compartment of the refrigerator, and while the tray assembly is inserted into or withdrawn from a refrigerating compartment, a shakiness of the tray assembly in the left and right directions is prevented.

BRIEF DESCRIPTION OF THE DRAWINGS

Other objects, characteristics and advantages of the present invention will become more apparent by describing in detail preferred embodiments thereof with reference to the attached drawings in which.

DETAILED DESCRIPTION OF THE INVENTION

Hereinafter, a preferred embodiment of the present invention will be explained in more detail with reference to the accompanying drawings.

Figure 1:
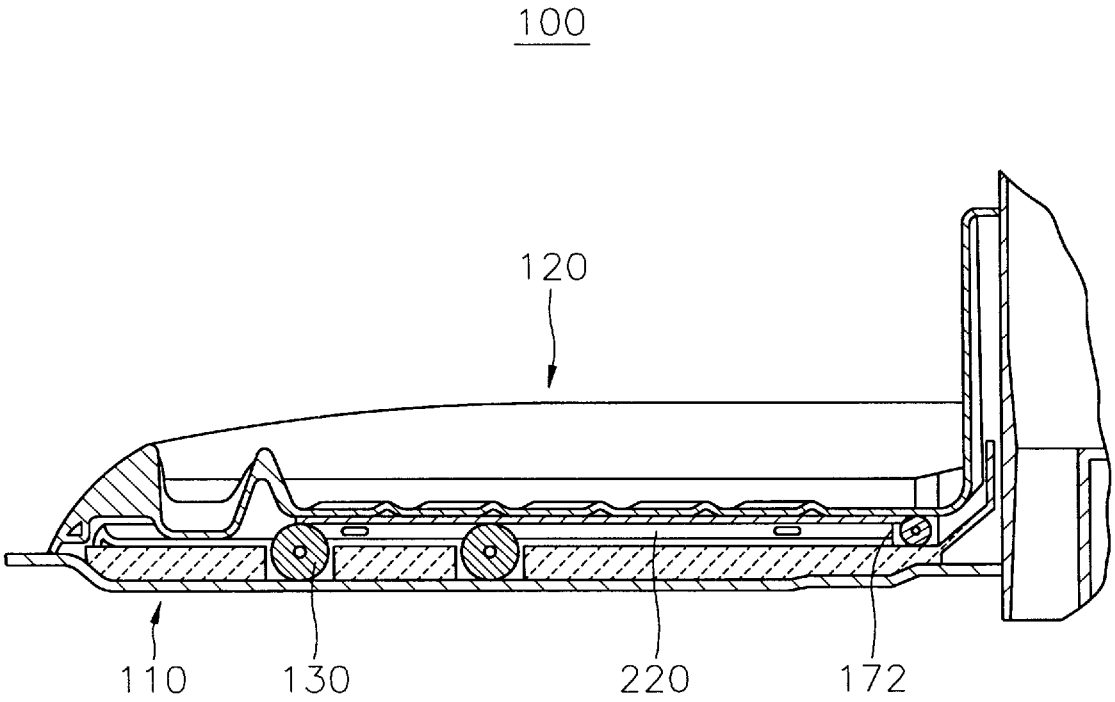
FIG. 1 (PRIOR ART)
FIG. 1 is a cross-sectional view for showing a tray assembly of a conventional refrigerator.
Figure 2:
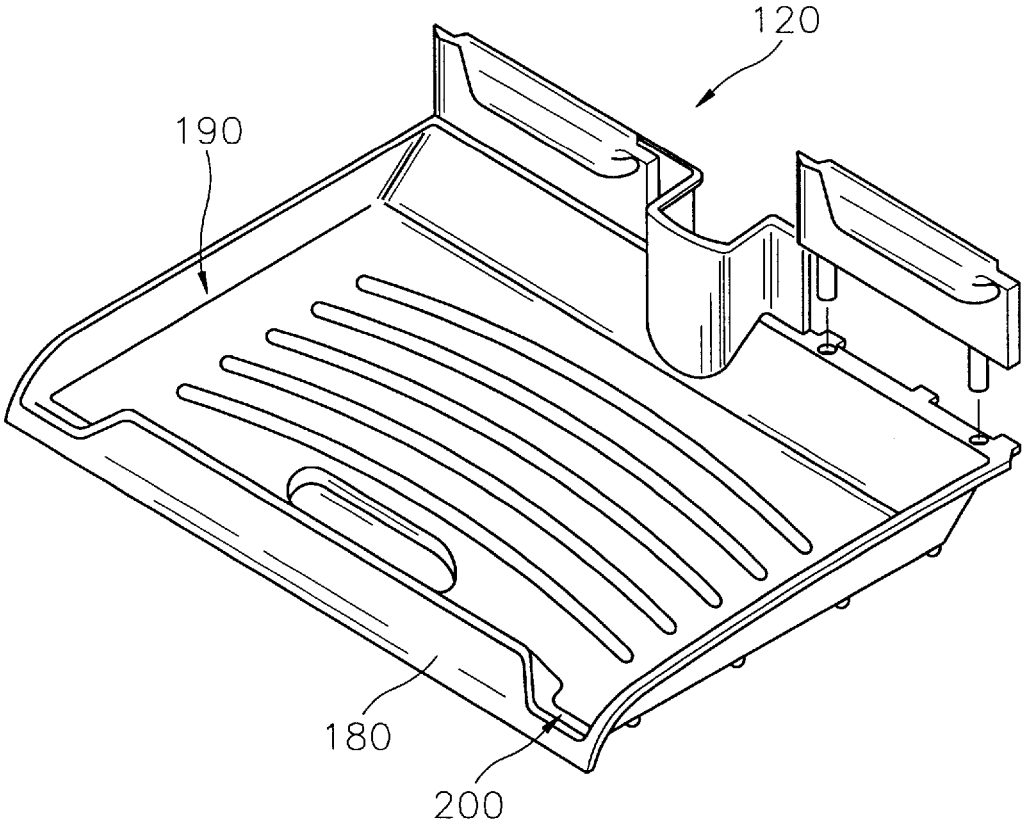
FIG. 2 (PRIOR ART)
FIG. 2 is a perspective view of the tray which is illustrated in FIG. 2.
Figure 3:
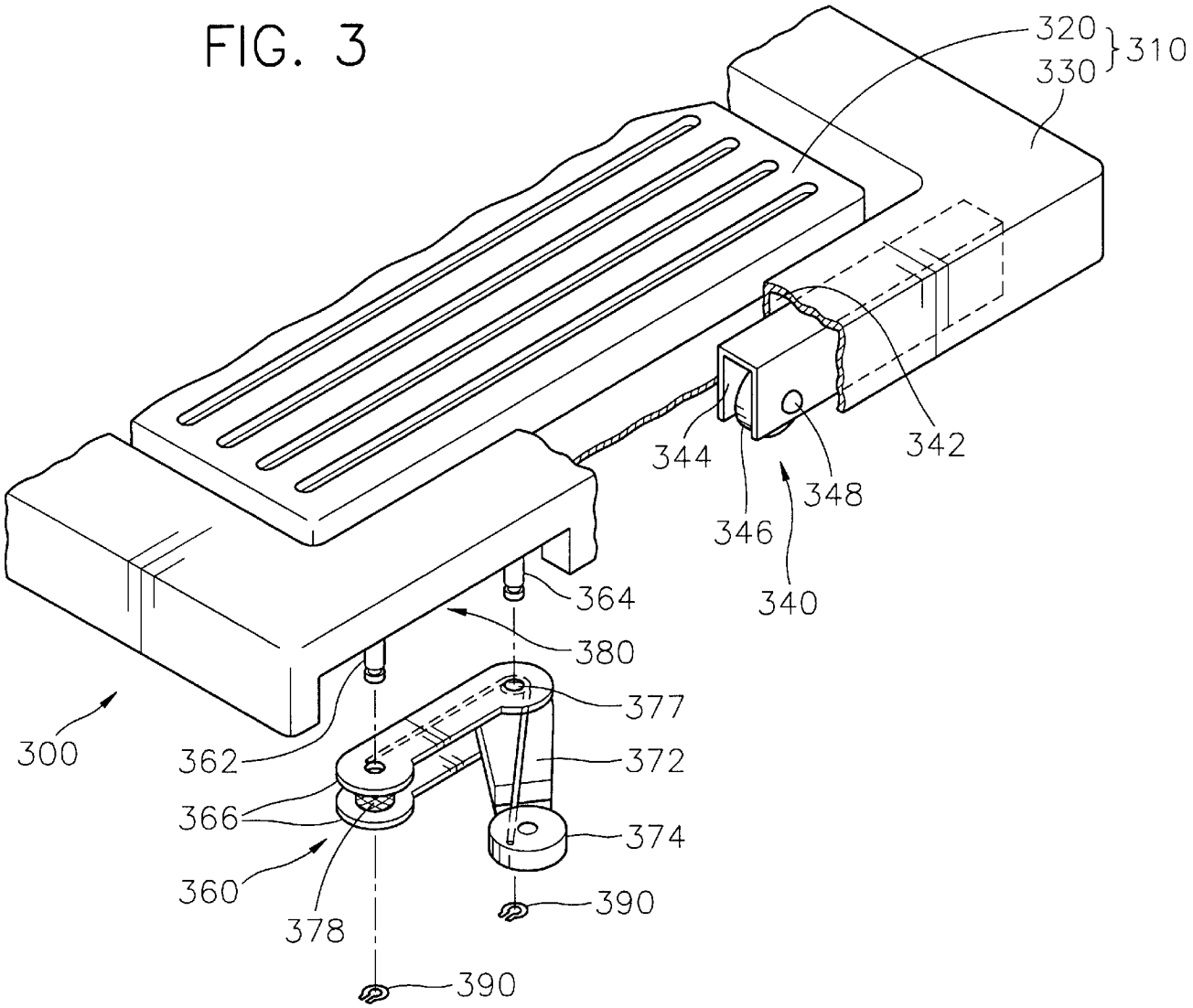
FIG. 3 is a disassembled perspective view for showing a construction of a tray assembly in accordance with the present invention.

FIG. 3 illustrates a tray assembly 300 for a refrigerator in accordance with the present invention. As illustrated in FIG. 3, the tray assembly 300 for a refrigerator in accordance with the present invention includes a tray 310 for storing foodstuffs, and a vertical roller part 340 and a horizontal roller part 360 for allowing the tray 310 to be easily inserted into and withdrawn from the refrigerating compartment and for preventing the tray 310 from shaking in the left and right directions while the tray 310 is being inserted into and withdrawn from the refrigerating compartment. The tray 310 includes a panel 320 on which foodstuffs are placed and an outer frame 330 provided around a brink of the panel for encompassing the panel 320.

Generally, the panel 320 is provided with holes for draining a liquid such as a defrosted liquid in the downward direction.

A pair of the grooves 342 is formed at both rear end portions of the outer frame 330, the vertical roller part 340 being installed in the pair of grooves 342. And a pair of recesses 380 is formed at front end portions of both sides of the outer frame 330, the horizontal roller part 380 being installed in the pairs of the recesses 380.

The vertical roller part 340 includes a roller bracket 344 mounted in the groove 342 of the outer frame 330, a vertical roller 346 installed in the roller bracket 344 so as to make moving contact with the guide members 302 which are formed at both side walls of the refrigerating compartment of the refrigerator, and a rotating pin 348 for rotatably coupling the vertical roller 346 to the roller bracket 344. The surfaces of the roller bracket 344 are spaced apart from each other more widely than the width of the vertical roller 346, and a pin hole 350 which is penetrated by the rotating pin 348 is formed at both sides of the roller bracket 344. The ring grooves 354 are formed at an end portion of the rotating pin 348 and E-rings 352 are coupled to the ring grooves 354 of the rotating pin 348 for preventing the vertical roller 346 from separating from the vertical roller part 340. The vertical roller 346 is rotatably installed in the roller bracket 344 by a rotating pin 348.

When the vertical roller 346 is assembled, a roller bracket 344 is installed in the grooves 342 of the outer frame 330 for encompassing the tray 310, and the vertical roller 346 is installed in the roller bracket 344. Then, a rotating pin 348 penetrates the pin holes 350 which are formed at both surfaces of the roller bracket 344. The vertical roller 346 is then put in contact with the surfaces of the guide members 302 which are installed at both side walls 392 of the refrigerating compartment.

The outer frame 330 is provided with a pair of recesses 380 at both front sides thereof, and the horizontal roller part 360 being rotatably installed in the pair of the recesses 380. Each of the recesses 380 has first 362 and second coupling pins 364 which are downwardly protruded for supporting the horizontal roller part 360, and the first coupling pin 362 is spaced apart from the second coupling pin 364 by a predetermined interval. The horizontal roller part 360 is provided with upper 366 and lower plates 368 which are inserted into first 362 and second coupling pins 364, a moving bar 372 which is inserted into the second coupling pin 364 and has a supporting shaft 370 which is protruded in the upward direction from a free end portion of the moving bar 372, a horizontal roller 374 which is rotatably coupled to the supporting shaft 370 of the moving bar 372, and a spring 376 which is placed between the moving bar 372 and the upper plate 366 and is coupled to the second coupling pin 364. The spring 376 pushes the moving bar 372 toward an inner wall 392 of the refrigerating compartment so that the horizontal roller 374 rotatably makes contact with the inner wall 392 of the refrigerating compartment.

Holes 377 are respectably formed at both end portions of the upper 366 and lower plates 368 so that the first 362 and second coupling pins 364 are coupled to the holes 377. A bush 378 for creating a space between upper 366 and lower plates 368 is provided at a position between upper 366 and lower plates 368 which corresponds to a position of the first coupling pin 362. The moving bar 372 including the horizontal roller 374 is placed at the space which is created by the bush 378.

The moving bar 372 is disposed between upper 366 and lower plates 368, and is inserted into the second coupling pin 364 through the hole 382 which is formed at the end portion of the moving bar 372. A supporting shaft 370 is protruded in the upward direction from a free end portion of the moving bar 372, and a horizontal roller 374 is rotatably coupled to the supporting shaft 370. The free end portion of the moving bar 372 is downwardly stepped and the supporting shaft 370 has a length larger than a width of the horizontal roller 372.

The spring 376 includes a first leg part 384, a second leg part 386 and an annular ring part 388 which is formed between first 384 and second leg parts 386. The first leg part 384 of the spring 376 makes contact with a supporting shaft 370 of the moving bar 372 so that the horizontal roller 374 which is coupled to the moving bar 372 is forced toward the inner wall 392 of the refrigerating compartment, and the second leg part 386 is fixedly supported by the bush 378. The annular ring part 388 which is formed between the first 384 and second leg parts 386 is coupled to the second coupling pin 364. A pair of E-rings 390 are coupled to end portions of the first 362 and second coupling pins 364 for preventing the horizontal roller part 360 from separting from the first 362 and second coupling pins 364.

The horizontal roller part 360 rotatably makes contact with side walls 392 of the refrigerating compartment of the refrigerator by the spring 376, and the tray 310 is inserted into and withdrawn from a refrigerating compartment without shakiness in the left and right directions.

Figure 4:
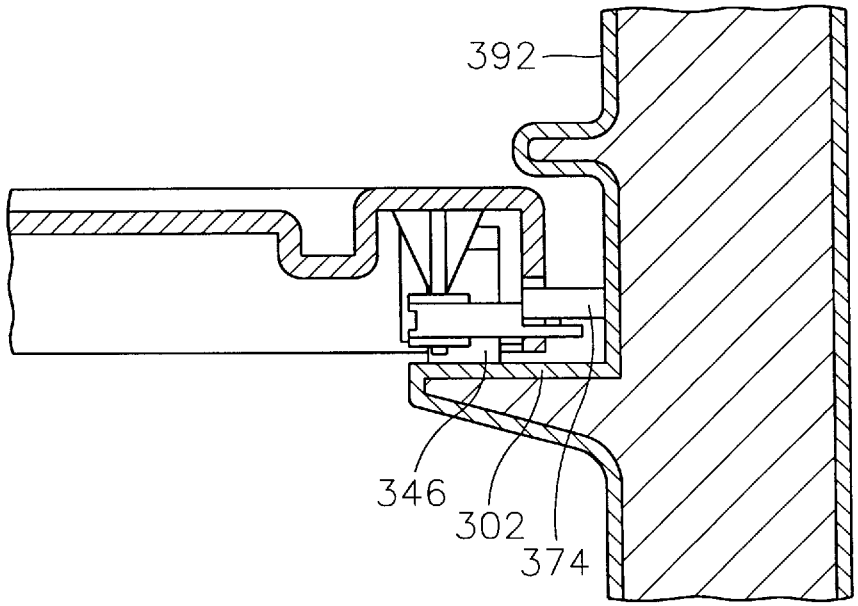
FIG. 4 is a sectional view for showing a mounting state of a tray assembly to a refrigerator in accordance with the present invention.

As illustrated in FIG. 4, the vertical roller 346 which is mounted at both end portions of an underside of the outer frame 330 is slidably coupled to guide members 302 of a refrigerating compartment. The horizontal roller 374 which is mounted at both sides of the outer frame 330 is elastically put in contact with a side wall of the refrigerating compartment.

Figure 5:
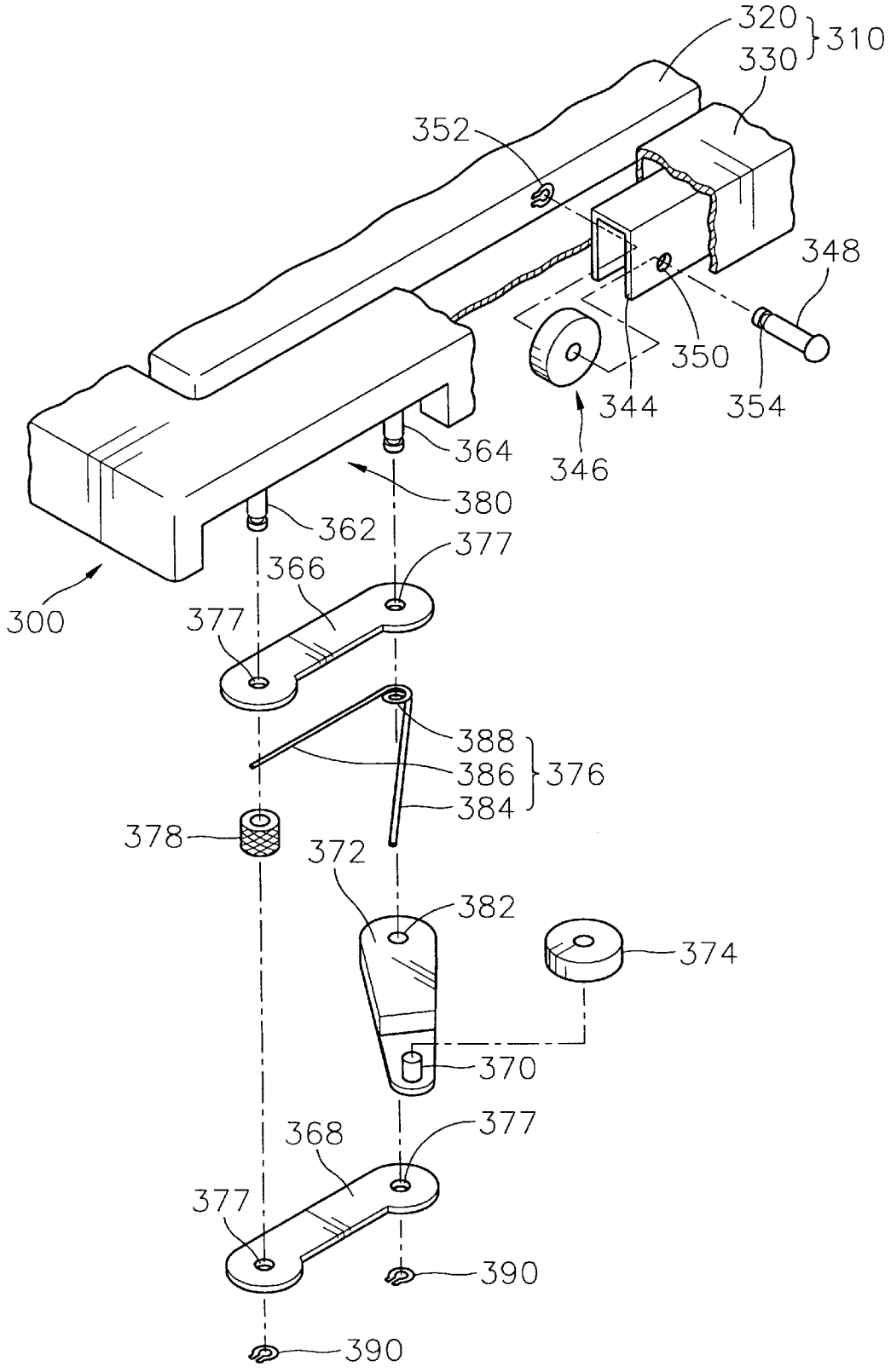
FIG. 5 is a disassembled perspective view for showing essential constructing elements of a tray assembly of a refrigerator in accordance with the present invention.

FIG. 5 illustrates an assembly order of a horizontal roller. That is, an outer frame 330 is provided first 362 and second coupling pins 364 which are downwardly protruded for supporting the horizontal roller part 360, and the upper plate 366 is coupled to the first 362 and second coupling pins 364. The bush 378 is inserted into the first coupling pin 362 and is provided between the upper 366 and lower plates 368. After the bush 378 is inserted into the first coupling pin 362, an annular ring part 388 of the spring 376 is inserted into the second coupling pin 364, and then the second leg part 386 is fixedly supported at an inner side of the bush 378. The moving bar 372 is inserted into the second coupling pin 364 through the hole 382 which is formed at an end portion thereof, and the horizontal roller 374 is rotatably coupled to the supporting shaft 370 which is protruded in the upward direction from a free end portion of the moving bar 372. After moving bar 372 is assembled, the first leg part 372 of the spring 376 is put in contact with an inside of the supporting shaft 370 which is protruded in the upward directions from the free end portion of the moving bar 372. After the above assembly, the lower plate 368 is inserted into the first 362 and second coupling pins 364 through the holes 377 which are formed at both end portions thereof. Finally, the horizontal roller part 360 is provided with a pair of E-rings 390 at the end portion of the first 362 and second coupling pins 364 for preventing the horizontal roller part 360 from separating from the first 362 and second coupling pins 364. Accordingly, when the tray assembly 300 is inserted into and withdrawn from the refrigerating compartment, the horizontal roller part 360 elastically makes contact with the inner wall 392 of the refrigerator by spring 376.

A tray assembly 300 for a refrigerator is slidably installed when the tray assembly 300 is inserted into and withdrawn from the refrigerating compartment since the vertical roller 346 is placed in contact with the surfaces of the guide members 302 which are installed at both side walls of the refrigerating compartment, and the horizontal roller part 360 which is placed in front of the vertical roller part 340 is elastically put in contact with an inner wall 392 of the refrigerator, thereby preventing a shakiness of the tray 310 in the left and right directions while the tray assembly 300 is inserted into or withdrawn from the refrigerating compartment, Accordingly, even in the case of heavy weight, the tray assembly 300 is able to be easily inserted into and withdrawn from the refrigerating compartment, and also a shakiness of the tray 310 in the left and light directions can be prevented.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A tray assembly for a refrigerator comprising:

a tray slidably coupled to a pair of guide members which are installed at both side walls of a refrigerating compartment;

a first means for allowing said tray to be easily inserted into and withdrawn from said refrigerating compartment, and being mounted on rear ends of both end portions of an underside of said tray; and a second means for allowing said tray to be easily inserted into and withdrawn from said refrigerating compartment and for preventing said tray from shaking in the left and right directions while said tray is being inserted into or withdrawn from said refrigerating compartment, and being mounted on front ends of both side surfaces of an underside of said tray, wherein said tray includes a panel on which foodstuffs are placed and an outer frame provided around a brink of said panel for encompassing said panel, said outer frame being formed at both rear end portions of an underside of said outer frame with a pair of grooves, said outer frame being formed at front end portions of both sides of said outer frame with recesses, the first means being installed in the pairs of grooves, the second means being installed in the recesses.

2. A tray assembly for a refrigerator as claimed in claim 1, wherein said first means includes a roller bracket mounted in the groove of said outer frame, a vertical roller installed in said roller bracket so as to make rolling contact with said guide members, and a rotating pin for rotatably coupling said vertical roller to said roller bracket.

3. A tray assembly for a refrigerator as claimed in claim 2, wherein said first means further comprises an E-ring which is coupled to an end part of said rotating pin for preventing said rotating pin from separting from said vertical roller.

4. A tray assembly for a refrigerator as claimed in claim 2, wherein said outer frame is provided with first and second coupling pins which are downwardly protruded for supporting said second means, said first coupling pin being spaced apart from said second coupling pin by a predetermined interval.

5. A tray assembly for a refrigerator as claimed in claim 4, further comprising a pair of E-rings which are coupled to end portions of said first and second coupling pins for preventing said second means from separting from said first and second coupling pins.

6. A tray assembly for a refrigerator as claimed in claim 4, wherein said second means includes upper and lower plates which are coupled to said first and second coupling pins, a moving bar which is inserted into said second coupling pin, is disposed between said upper and lower plates, and is provided at a free end thereof with a supporting shaft which is protruded in the upward direction, a horizontal roller rotatably coupled to said supporting shaft of said moving bar, and a spring which is placed between said moving bar and said upper plate, said spring being coupled to said second coupling pin, said spring pushing said moving bar toward an inner wall of said refrigerating compartment so that said horizontal roller rotatably makes contact with said inner wall of said refrigerating compartment.

7. A tray assembly for a refrigerator as claimed in claim 6, wherein a free end portion of said moving bar is downwardly stepped, and said supporting shaft has a length larger than a width of said horizontal roller.

8. A tray assembly for a refrigerator as claimed in claim 6, wherein said first coupling pin and said second coupling pin are respectively inserted into holes formed at both end portions of said upper and lower plates, and a bush for keeping a distance between said upper and lower plate is provided at a position between said upper and lower plates which corresponds to a position of said first coupling pin.

9. A tray assembly for a refrigerator as claimed in claim 8, wherein said spring includes a torsion spring having a first leg part, a second leg part and on annular ring part which is formed between the first leg part and the second leg part, the first leg part of the spring makes contact with a projection of the moving bar so that said moving bar is forced toward the inner wall of said refrigerating compartment, and the second leg part is fixedly supported by said bush.

* * * * *